United States Patent [19]

Cook

[11] 4,015,386

[45] Apr. 5, 1977

[54] FIRE-RETARDANT LOW TEMPERATURE INSULATING BUILDING PANEL

[75] Inventor: Sanford L. Cook, Edison, N.J.

[73] Assignee: Clark Door Company, Inc., Cranford, N.J.

[22] Filed: Feb. 7, 1975

[21] Appl. No.: 547,919

[52] U.S. Cl. ..... 52/232; 29/527.1; 52/303; 264/46.5; 264/46.7; 428/70; 428/71; 428/921

[51] Int. Cl.[2] ..... E04C 2/26; E04B 1/94

[58] Field of Search ..... 52/232, 303; 428/921, 428/71, 70, 76, 310; 264/46.6, 46.7, 46.5; 29/469, 527.1

[56] References Cited

UNITED STATES PATENTS

| | | | |
|---|---|---|---|
| 2,787,345 | 4/1957 | Soubier et al. | 52/232 |
| 3,334,464 | 8/1967 | Charles | 52/303 X |
| 3,462,339 | 8/1969 | Poms | 52/232 X |
| 3,566,564 | 3/1971 | Gaeth et al. | 52/232 |

FOREIGN PATENTS OR APPLICATIONS

| | | | |
|---|---|---|---|
| 1,203,461 | 8/1970 | United Kingdom | 428/921 |
| 1,181,432 | 2/1970 | United Kingdom | 428/921 |
| 1,084,503 | 9/1967 | United Kingdom | 428/921 |

*Primary Examiner*—Alfred C. Perham
*Attorney, Agent, or Firm*—Cohn, Powell & Hind

[57] ABSTRACT

A fire-resistant door or other building panel for cold storage compartments includes a sheet-metal casing containing a core of plastic foam insulation with a layer of a hydrous sodium silicate composition between the plastic foam core and the walls of the casing. In case of fire or high temperature conditions near the panel the silicate composition expands, forming a thick, cellular heat barrier that shields the foam plastic and affords fire protection equivalent to that of an approved fire door.

4 Claims, 4 Drawing Figures

FIRE-RETARDANT LOW TEMPERATURE INSULATING BUILDING PANEL

BACKGROUND OF THE INVENTION

The present invention relates to improvements in insulated doors, building panels and the like, and more particularly to an improved insulated panel for cold storage compartments.

Because of their extremely low thermal conductivity at low temperatures foamed plastic resins are superior materials for insulating cold-storage wall panels. The best and most widely used of these plastic insulants for the stated purpose is polyurethane foam. These materials, however, have the serious disadvantage of disintegrating when subjected to high temperatures. Some, like polyurethane foam, are flammable and produce toxic fumes when ignited. Where fire safety is an important factor, a panel insulated with polyurethane foam requires a supplemental fire-resistant panel to provide first protection and meet code and insurance requirements.

The present invention fulfills a pressing need for a single panel having the combined properties of a fire door and an efficient cold storage door, dual qualities which heretofore have not been obtainable in a unitary cold storage door or panel.

SUMMARY OF THE INVENTION

A metal-clad cold storage door, panel, or the like, containing polyurethane foam insulation has a solid layer of non-combustible, heat-expandable composition material between the cladding metal and urethane foam core. In accordance with the present invention the material intervening the core and casing walls essentially consists of hydrated sodium silicate, preferably held in a binder of glass or asbestos fibres. Vent openings in the casing provide for the controlled emission of gases which may be created internally of the casing by the action of high temperature heat acting on the polyurethane core.

At temperature in excess of 200° F the initially solid or crystalline sodium silicate expands and converts to a relatively thick blanket or layer of rigid, cellular composition having high heat-resisting insulating properties, transforming the panel into an effective fire and heat barrier.

The principal object of the invention is achieved in this provision of an insulated door or other building panel that affords excellent resistance to the passage of heat when in a relatively low-temperature ambience, and which, when subjected to high temperature heat, will become an effective fire and heat barrier.

Another object resides in the provision of a door or panel with the insulating and fire-resisting qualities heretofore described, and which conforms to the code and underwriters' requirements for cold storage and fire door.

These and other objects and advantages will appear and be more fully explained as the description proceeds.

DESCRIPTION OF THE PREFERRED EMBODIMENT

Figure 1:
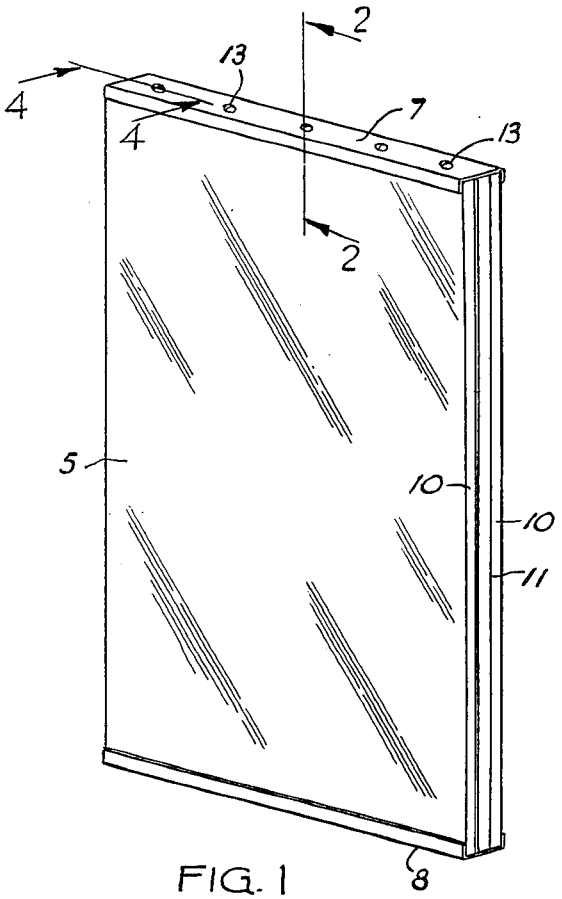
FIG. 1 is an isometric view of a door or panel of the present invention.
Figure 2:
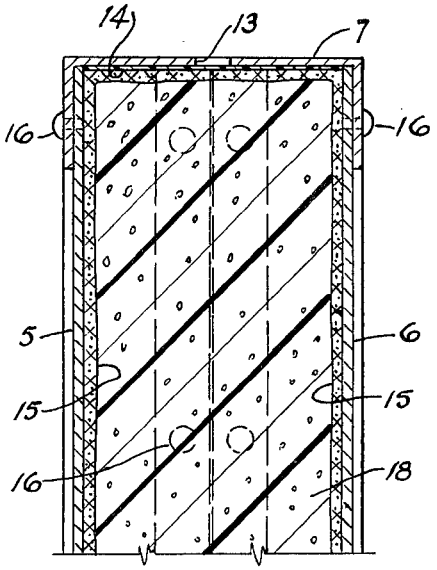
FIG. 2 is a fragmentary sectional view through the panel, taken at line 2—2 of FIG. 1.

With reference to the drawings, the insulated panel hereof comprises a sheet metal jacket or casing structure having outer and inner side walls designated 5 and 6 respectively, top and bottom channel-shaped strips 7 and 8, these being desirably formed from sheet and strip metal stock. As with the casings of certain prevailing types of cold storage door constructions these inner and outer panel members 5 and 6 may be provided with inturned edge flanges 10, which flanges are interconnected by closure strips 11, secured to the flanges 10 as by machine screws or rivets 16. Vent apertures 13 are provided in an upper wall part for the release of gas and vapor generated within the casing by any degrading of the core body as the result of high temperature. To prevent moisture from entering the casing through the vent openings 13 during normal usage the openings 10 are sealed, as a strip 14 of polyethylene film is secured to the inner side of the casing wall in underlying relation to the vent openings.

Prior to their assembly the inner surfaces of the casing wall parts are coated with a lining layer 15 of the intumescent siliceous composition. The lining layer 15 consists essentially of a hydrous alkali metal silicate, such as sodium or potassium silicate having water content of from 10 to 40 percent by weight. Since the panel may, in service, be subjected to impactive forces the silicate lining layer may be advantageously strengthened mechanically by the inclusion of asbestos or glass fibers mixed with the silicate compound, in amounts up to 30 percent by weight thereof. Other incombustible insulating materials such as bentonite or diatomaceous earth, may be incorporated in the silicate solution in amounts not exceeding 20 percent by weight of the hydrous silicate.

The described lining composition is spread by suitable means on the inner surfaces of the casing wall members to form a layer thereof of from one-eighth to one-quarter inch in thickness. With the evaporation of excess water from the silicate composition, which may be accelerated by the application of mild heat, not to exceed 90° C, the composition becomes solidified and firmly attached to the inner surfaces of the casing parts.

Another method of forming the inner lining layer is to lay one or more plies of loosely woven fiber glass or asbestos cloth on the sheet metal casing wall and applying sodium silicate solution to the plies at intervals, until a layer of the desired thickness of the silicate has been obtained. The blanket thusly formed is desirably compressed to densify and reduce its thickness.

Pressure to densify and compact the silicate blanket of sodium against the inner sheet metal wall parts may be accomplished by means of pressure rollers, or by compressing the composition and casing wall member between coacting clamp plates of a suitable press.

In yet a third method, pre-formed, board-like panels of the siliceous composition are cut to shape and adhesively secured to the inner wall surfaces of the casing member, as by an epoxy cement.

The wall parts with their inner surfaces covered by the layer of silicate composition by one of the methods above described are then assembled and secured together by suitable metal fasteners 16. Welding is not recommended since the heat could cause premature intumescence of the lining composition. The lined casing next is filled with polyurethane or other polymeric foam resin 18, the liquid constituants thereof being introduced into the hollow interior through suitable openings in the casing wall, following well-known practices.

Figure 3:
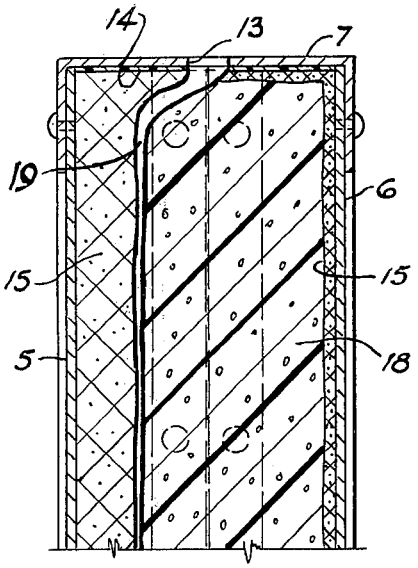
FIG. 3 is a sectional view, similar to that of FIG. 2, illustrating a transformed core structure as caused by flame and heat acting on one side of the panel.
Figure 4:
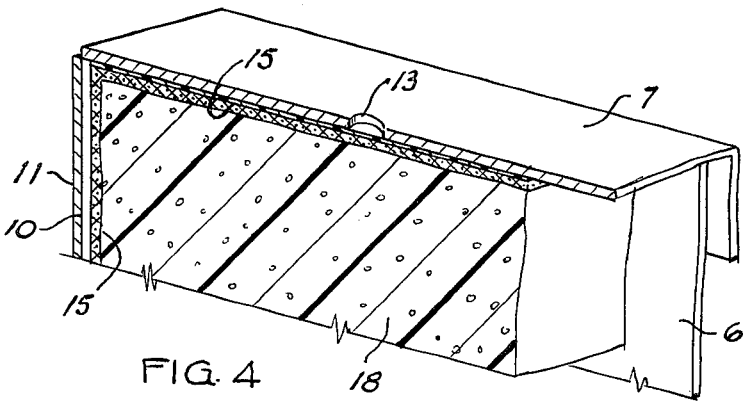
FIG. 4 is a fragmentary sectional view taken at line 4—4 of FIG. 1.

The fire retardant, insulating panel structure provided by the described laminated layers of metal, silicate composition and foamed polymeric resin afford excellent thermal insulation at low ambient temperatures, and achieves superior fire resistant properties when subjected to temperatures above 200° F. Should a fire develop in a building at one side of the panel hereof, the following would occur: at temperature from 100° to 150° C the silicate lining material softens and its water of crystallization begins to vaporize. The material foams, expands and, when all water has been expelled, becomes a relatively thick, rigid wall of porous, pumice-like insulation between the steel casing and the polyurethane. In its converted form the foamed siliceous material checks heat flow to the urethane core, through the panel, and provides heat and fire protection for a period of time in excess of that required for classification as an A-rated fire door.

Where heat at a side of the panel is of sufficient intensity and duration to pass through the silicate barrier 15 and cause degrading of the adjacent foam plastic core 18 a space or passageway between these layers will be formed, such as is indicated at 19, FIG. 3. Gases in this zone produced from the decomposing plastic will be released through the casing openings 13 where they may ignite and burn to harmless by-products.

Whereas the wall panel of the present invention has been described herein as employing sheet metal for the material of the outer casing or jacket structure, and sheet metal is to be preferred where the panel is required to withstand flame and high heat conditions for a period of three hours or more (the present requirements for a class A rated door or panel), a sheet metal casing is not essential if less stringent requirements govern. In such cases, as where fire protection for a period of one hour or less will be adequate, the casing may be constructed of heavy sheeting material formed from polyvynol chloride, or other suitable plastic resin, or fibre glass sheeting.

I claim as my invention:

1. A fire-retardant low temperature insulating panel comprising:

a. a sheet metal casing having top, bottom, side and end walls, b. a layer of hydrous alkaline metal silicate substantially completely lining the interior surfaces of said casing, and c. a poured core of polymeric foam resin filling the interior of the lined enclosure.

2. A fire retardant low temperature insulating panel comprising:

a. a sheet metal casing having top, bottom, side and end walls, and having vent openings in an upper wall portion, b. preformed sheets of hydrous alkaline metal silicate, reinforced with embedded non-combustible fibers, substantially completely lining the interior surfaces of said casing walls, and having vent openings in register with the vent openings of the upper wall portion, c. a moisture impervious film disposed between said upper wall portion and associated lining in extending relation across the vent openings, and d. a poured core of polymeric foam resin filling the interior of the lined casing.

3. The herein described method of constructing a low temperature insulated, fire resistant panel which comprises:

a. forming sheet material into casing wall parts having inner and outer surfaces, b. lining said inner surfaces with preformed sheets of a fiber reinforced intumescent, alkaline silicate composition, c. assembling the lined wall parts to form a substantially completely lined hollow casing, and d. filling said hollow casing with a polymeric foamed in place core.

4. The herein described method of constructing a low temperature insulated, fire-resistant panel which comprises:

a. cutting and bending sheet metal to form casing wall parts including top, bottom, side and end walls having inner and outer surfaces, b. perforating an upper wall portion with vent openings, c. mixing liquid hydrous sodium silicate with fibrous material to form reinforced sheets, d. forming corresponding vent openings in associated sheets, e. applying a film or moisture impervious material over said vent openings of said upper wall portion, f. applying the sheets to the inner surfaces of said wall parts to form a lining having said corresponding sheet vent openings in register with said casing vent openings, g. assembing the wall parts to form a substantially completely lined hollow casing, and h. filling the interior of the casing with foamed-in-place polyurethane.

* * * * *